US007341460B1

(12) United States Patent
McHugh et al.

(10) Patent No.: US 7,341,460 B1
(45) Date of Patent: Mar. 11, 2008

(54) ELECTRICAL CONNECTOR

(75) Inventors: Robert G. McHugh, Golden, CO (US); Chia-Wei Fan, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/648,467

(22) Filed: Dec. 28, 2006

(51) Int. Cl.
*H01R 12/00* (2006.01)

(52) U.S. Cl. ..... 439/71; 439/83; 439/569

(58) Field of Classification Search ..... 439/70–71, 439/82–83, 569
See application file for complete search history.

(56) References Cited

U.S. PATENT DOCUMENTS 4,345,810 A * 8/1982 Bakermans ..... 439/71
5,221,209 A * 6/1993 D'Amico ..... 439/71
6,198,630 B1 * 3/2001 Cromwell ..... 361/704
6,541,991 B1 * 4/2003 Hornchek et al. ..... 324/755
6,835,072 B2 * 12/2004 Simons et al. ..... 439/66
6,923,658 B2 * 8/2005 Cromwell et al. ..... 439/71

* cited by examiner

*Primary Examiner*—Truc Nguyen
(74) *Attorney, Agent, or Firm*—Wei Te Chung

(57) ABSTRACT

An electrical connector for electrically connecting a chip module with a printed circuit board (3), the printed circuit board (3) defines a number of second holes (3) and a central hole, (3) the electrical connector comprises, a housing (3) fixed on the printed circuit board (3) comprising a plurality of passageways (3) and a number of holes (3) therein, a plurality of terminals received in the passageways of the housing (3), at least one upper alignment plate (3) attached on a top surface of the printed circuit board (3) with a receiving portion (3) for receiving corner of the housing (3) and a number of first holes (3) therein, at least lower alignment (3) attached on a bottom surface (3) of the printed circuit board (3) corresponding to the upper alignment plate (3) with a number of third hole (3), a number of alignment member (3) inserted into the first holes (3), and the second holes (3), the third holes (3) for connecting the upper alignment plate (3), the lower alignment plate (3) to the printed circuit board (3), wherein the ear portions (3) engage with the receiving portion (3) of the upper alignment plate (3) by interfering engagement.

11 Claims, 4 Drawing Sheets

ELECTRICAL CONNECTOR

BACKGROUND OF THE INVENTION

1. Field of the Invention

The present invention relates to an electrical connector for electrically connecting an electronic package with a printed circuit board.

2. Description of Prior Art

Electrical connectors are widely used in personal computer (PC) systems to electrically connect chip modules with printed circuit boards (PCBs). An electrical connector comprises an insulative housing, a multiplicity of terminals received in the housing in a rectangular array, a metal cover pivotally mounted to the housing, and a lever attached to the housing and a stiffener mounted on a lower end of the housing.

A related art please refer to the U.S. Pat. No. 6,969,267 which discloses an apparatus comprising: a retention frame having frame portions to carry fasteners; a socket carrying a first set of contacts to engage contacts of an IC and positioned within the retention frame such that portions of the frame surround the socket and such that ledges carried by the socket are positioned opposite ledges carried by the retention frame; a load plate pivotally coupled to the retention frame; and a load lever pivotally coupled to the retention frame and having a load point to engage a load point carried by the load plate to retain and press the load plate towards the retention frame to press contacts carried by the package of an IC against the first set of contacts carried by the socket into engagement to create electrical connections therebetween, and to press the ledges carried by the socket against the ledges carried by the retention frame.

However, connection apparatus abovementioned comprises many components thereof and the assembly of the socket is too much complicate.

A new electrical connector that overcomes the abovementioned problems is desired.

SUMMARY OF THE INVENTION

An object of the present invention is to provide an electrical connector connecting a chip module to a printed circuit board which is able to balance the force applied on solder balls, hence preventing the solder balls from cracking or breaking.

In order to achieve the above object, an electrical connector in accordance with a preferred embodiment of the present invention comprises a housing fixed on a printed circuit board with a pair of ear portions on a diagonal line thereof, a pair of upper alignment plates arranged beside the ear portion of the housing and attached on a top surface of the printed circuit board, and a pair of lower alignment plates attached to a bottom surface of the printed circuit board corresponding to the position of the upper alignment plates, a pair of connecting pins for connecting the housing, the lower alignment plates to the printed circuit board. The housing defines a plurality of passageways receiving a plurality of terminals therein for connecting the chip module with the printed circuit board. The ear portion defines a through hole for receiving the connecting pins therein. Each upper alignment plate defines and lower alignment plate defines a pair of receiving holes for receiving respectively and a through hole for receiving the pin therein. In assembly, the connecting pins extend through the holes of the housing, holes of the printed circuit board and the lower alignment plate connecting the housing on the printed circuit board, and the upper alignment plate and lower alignment plate attached on the upper surface and lower surface of the printed circuit board by some screws for enforcing the connection between the chip module to seated on the housing and the printed circuit board.

The upper surface and lower surface of the printed circuit board by some screws for enforcing the connection between the chip module to seated on the housing and the printed circuit board, hence improving the connection feature between the conductive pins of the chip module seated on the housing and the printed circuit board and preventing the solder ball of the terminals attached to the printed circuit board from cracking or breaking due to deformation of the printed circuit board.

Other objects, advantages and novel features of the present invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
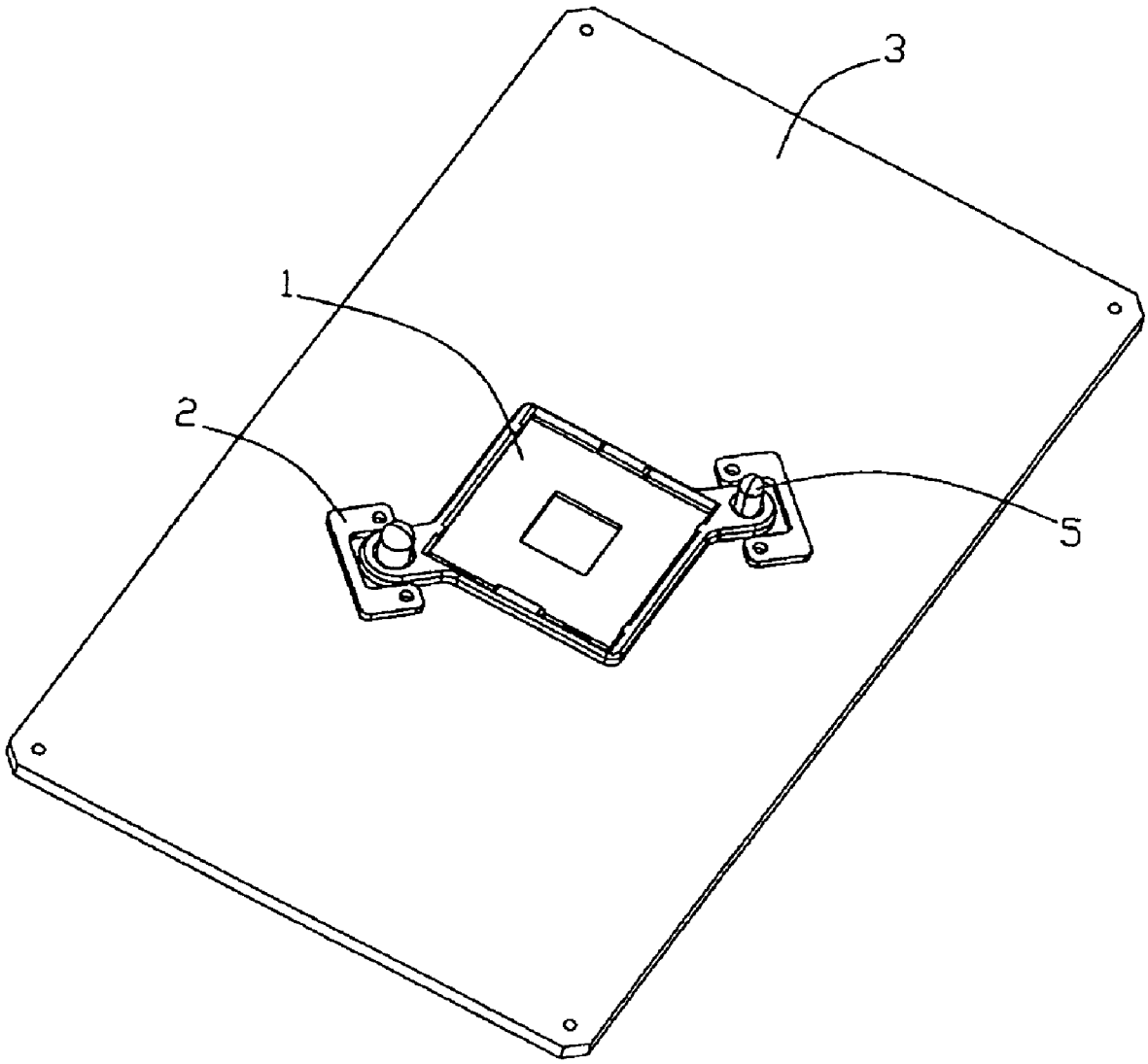
FIG. 1 is an assembled view of an electrical connector in according with invention attached on a printed circuit board.
Figure 2:
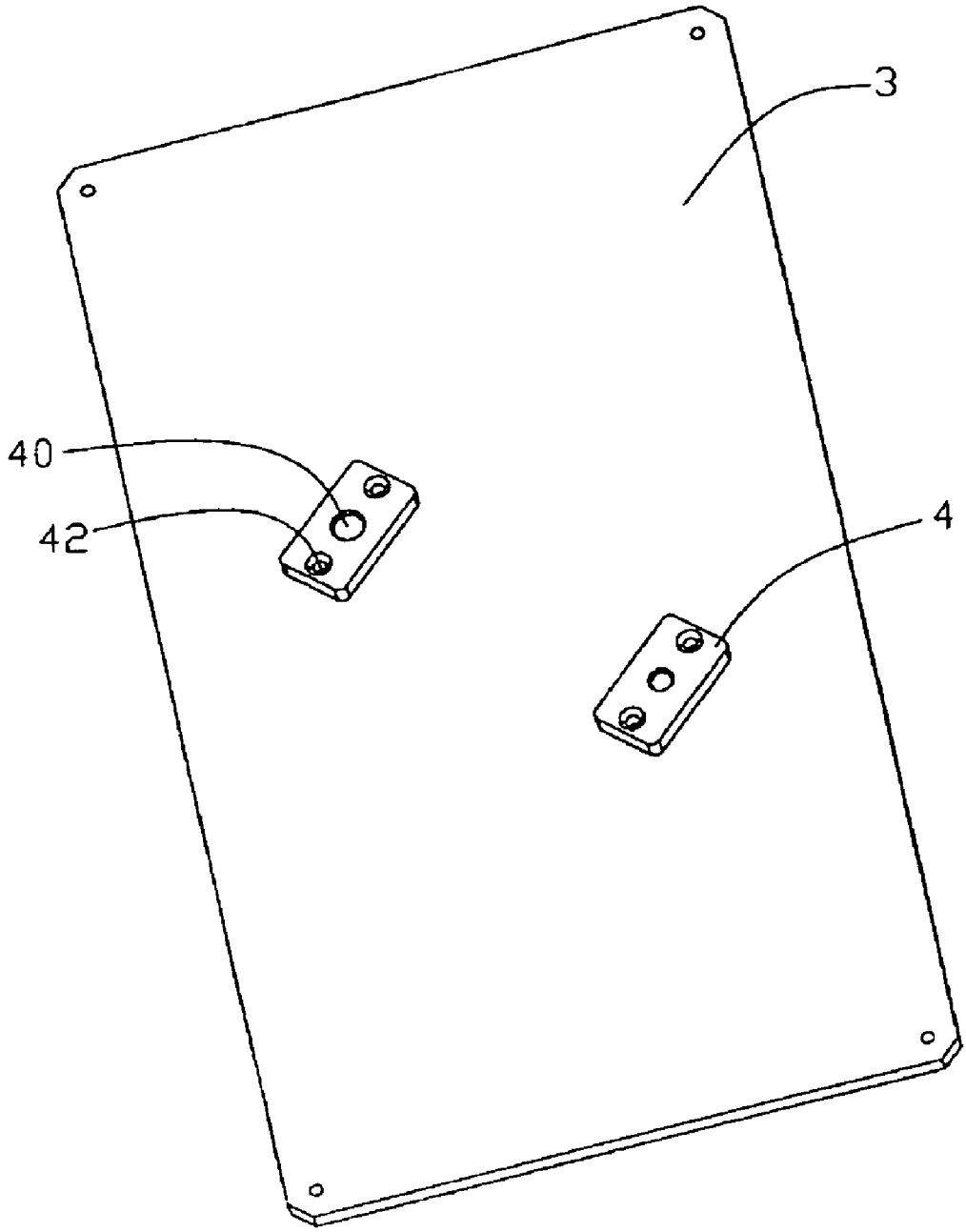
FIG. 2 is a bottom view of the electrical connector assembled with printed circuit board shown in FIG. 1.
Figure 3:
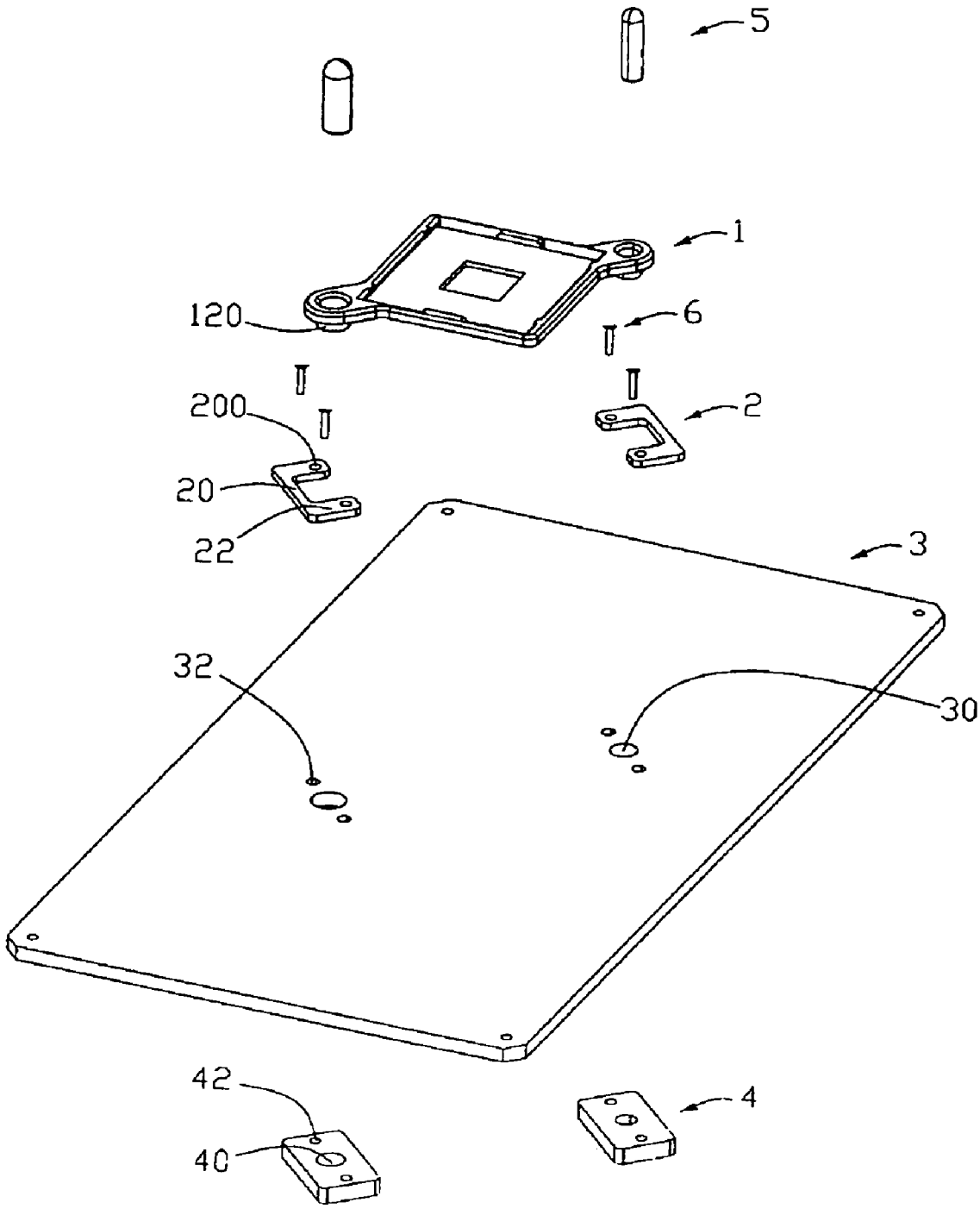
FIG. 3 is an exploded, isometric view of the electrical connector shown in FIG. 1.
Figure 4:
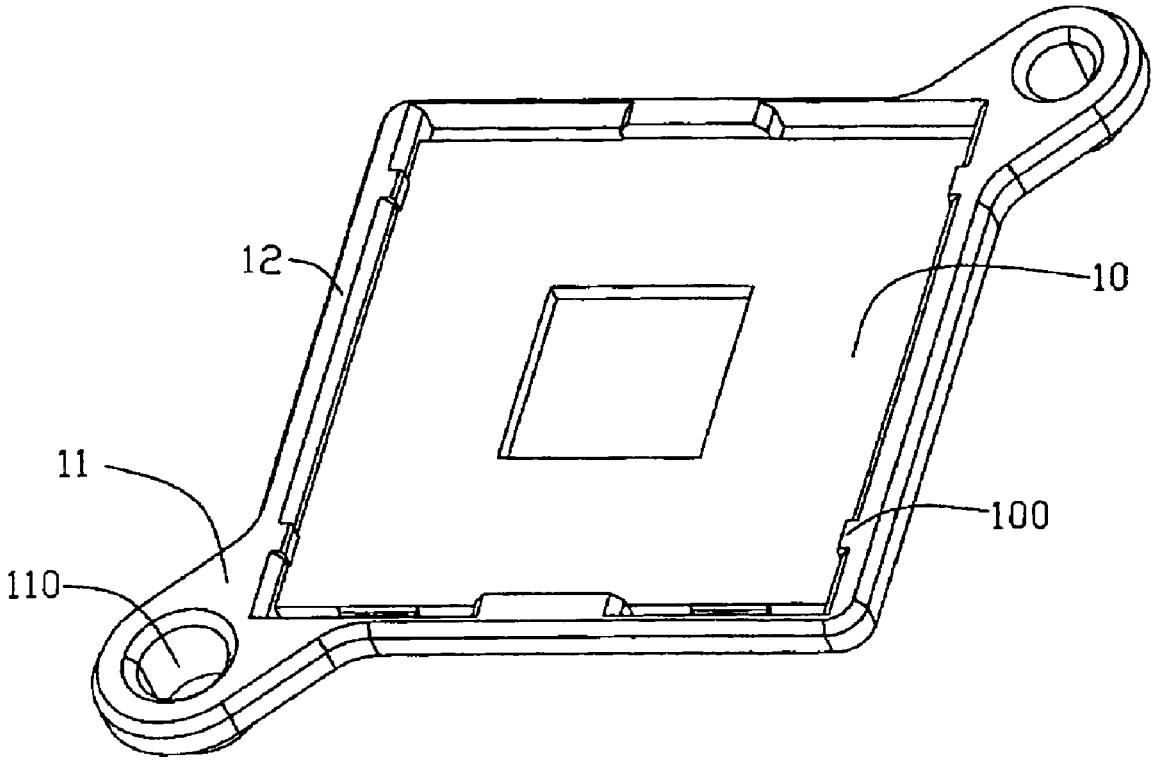
FIG. 4 is an isometric view of the housing described in the electrical connector shown in FIG. 1.

Referring to FIGS. 1-4, an electrical connector in accordance with the preferred embodiment of the present invention is adapted for electrically connecting an electronic package such as a chip module (not shown) with a printed circuit board such as a printed circuit board (PCB) 3. The electrical connector comprises a housing 1 fixed on the PCB 3, a pair of upper alignment plates 2 and a pair of lower alignment plates 4 attached on an upper surface and a lower surface of the printed circuit board 3 respectively for enforcing the connection between the housing 1, terminals and the printed circuit board 3, a pair of alignment members 5 for attaching the housing 1 and lower alignment plates 4 to the printed circuit board 3 respectively and a number of alignment pins 6 for further enforcing the engagement between the upper alignment plates 2, the lower alignment plates 4 and the printed circuit board 3.

The housing 1 is rectangular shape and comprises a receiving section 10 for receiving the chip module thereon, four sidewalls 12 extending from sides of the receiving section 10, and a pair of ear portions 11 outwardly extending from corners of housing 1 in a diagonal direction, each ear portion 11 defining a receiving hole 110 on a center thereof, and a pair extending portion 120 in shape of ring downwardly extending from the hole 110 of the ear portions 11 for inserting into printed circuit board 3. In addition, sidewalls 12 define a number of projections 100 for engaging with chip module.

The upper alignment plate 2 is U-shaped and includes a body portion 20, and a pair of arm portions 22 extending from two symmetrical portions of the body portion 21 with a pair of first holes 200 therein for receiving the alignment members 6 therein, and a receiving portion sandwiched by the arm portions 22 for receiving the ear portions 11 of the housing 1 therein.

The lower alignment 4 attached on the lower surface of the printed circuit board 3 is in a rectangular shape and comprises a pair second holes 42 for receiving the alignment members 5 therein and a center hole 40 for receiving the pins 5 therein.

The printed circuit board 3 defines two pairs of third holes 32 corresponding to the receiving holes 200, 42 of the upper and lower alignment plates 2, 4 and a central hole 30 sandwiched by the third holes 32 for receiving the pins 5 therein.

In assembly, the housing 1 is firstly mounted on the printed circuit board 3 with the extending portions 120 inserted into the central holes 30 of the printed circuit board 3. Then the upper alignment plates 2 are arranged beside the ear portions 11 of the housing 1 and attached on the printed circuit board 3 too with the first holes 200 of the upper alignment plate 2 communicating with the third holes 32 of the printed circuit board 3. Successively, the lower alignment plates 4 attached on the lower surface of the printed circuit board 3 with the second holes 42 of the lower alignment plate communicating with the third holes 32 of the printed circuit board 3. Then inserting the alignment members 5 from holes 110 of the housing 1 to the central hole 30 of the printed circuit board 3 and the center holes 40 of the lower alignment plate 4 for positioning the relative relation between the housing 1, the lower alignment plate 2 and the printed circuit board 3. At the moment, a number of alignment pins 6 are inserted into the first holes 200 of the upper alignment plate 2, the second holes 32 of the printed circuit board 3 and the third holes 42 of the lower alignment plate 4 for connecting the upper alignment plates 2 and the lower alignment plates 4 on the printed circuit board 3. At last, the chip module is mounted on the receiving section of the housing 1 and conductive terminals received in the housing are soldered to the printed circuit board.

It is to be understood that the shape of the upper alignment plates 2 and the lower alignment plate 4 can be altered in alignment with the real engagement situation between the housing 1 and the printed circuit board 3.

While the preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector assembly comprising, a printed circuit board;

a housing fixed on the printed circuit board comprising a plurality of passageways;

a plurality of terminals received in the passageways of the housing;

at least one lower alignment plate attached on a bottom surface of the printed circuit board;

a number of alignment member interferingly connecting the housing, the lower alignment plate to the printed circuit board;

wherein at least one upper alignment plate is attached on a top surface of the printed circuit board corresponding to the at least one lower alignment plate, and the housing comprises at least one ear portion disposed on a corner of the housing to engage with a corresponding receiving portion of the upper alignment plate by interfering engagement.

2. The electrical connector assembly as claimed in claim 1, wherein at least one upper alignment plate defines a number of first holes, at least one lower alignment plate defines a number of second holes, and the print circuit board defines a number third holes for receiving the alignment members therein.

3. The electrical connector assembly as claimed in claim 1, wherein the housing further comprises a pair of extending member downwardly extending from the corresponding ear portions for being inserted into central holes of printed circuit board.

4. The electrical connector assembly according to claim 1, wherein the upper alignment plate is defined as an U-shaped configuration and comprises a body portion and a pair of arm portions symmetrically extending from body portion, and a receiving portion sandwiched by the two arms for receiving the ear portions of the housing therein.

5. An electrical connector assembly for electrically connecting a chip module with a printed circuit board, the electrical connector comprising:

an insulative housing having a plurality of contacts, the insulative housing having a plurality of passageways therein;

at least one upper alignment plate having a receiving concave for interferentially attaching the housing on an upper surface of the printed circuit board and a number of holes;

a number of alignment members;

wherein the upper alignment plate defines a number of first positioned holes and the printed circuit board defines a number second positioned holes, in assembly, the alignment members inserted into the first positioned holes of the upper alignment plate and the second positioned holes of the printed circuit board for connecting the housing to the printed circuit board;

wherein the connector assembly further comprises at least one lower alignment plate attached on a lower surface of the printed circuit board having a number of third positioned hole corresponding to the first positioned holes and the second positioned holes for receiving the alignment members; and wherein the housing further comprises at least one through hole and the lower alignment plate and printed circuit board respectively define a connecting hole and a alignment hole corresponding to the through hole of the housing for receiving alignment pins therein.

6. An electrical connector assembly for electrically connecting a chip module with a printed circuit board, the electrical connector comprising:

a housing fixed on the printed circuit board comprising a plurality of passageways, a pair of ear portions extending in a diagonal direction and a number of holes therein;

a plurality of terminals received in the passageways of the housing;

at least one upper alignment plate attached on a top surface of the printed circuit board with a receiving portion for receiving corner of the housing and a number of first holes therein;

the printed circuit board defining a number of second holes and a central hole;

at least one lower alignment plate attached on a bottom surface of the printed circuit board corresponding to the upper alignment plate with a number of third hole;

a number of alignment members inserted into the first holes, and the second holes, the third holes for connecting the upper alignment plate, the lower alignment plate to the printed circuit board;

wherein the ear portions engage with the receiving portion of the upper alignment plate by interfering engagement.

7. The electrical connector assembly according to claim 6, wherein the housing further comprises at least one through hole and the lower alignment plate and printed circuit board respectively define a connecting hole and alignment hole communicating with the through hole of the housing.

8. The electrical connector assembly according to claim 7, further comprising at least one alignment pin inserted into the through hole of the housing, the connecting hole of the printed circuit board and the lower alignment plate for connecting the housing and the lower alignment plate to the printed circuit board.

9. The electrical connector assembly as claimed in claim 5, wherein the upper alignment plate is essentially coplanar with the housing, the housing has no direct strong retention with the upper alignment plate but with a lower alignment plate which is attached to an undersurface of the printed circuit board and has direct strong retention with the housing via another alignment pin extending through the housing, the printed circuit board and the lower alignment plate.

10. An electrical connector assembly for electrically connecting a chip module, comprising:

a printed circuit board;

an insulative housing having a plurality of contacts therein and at least one fastening area at a corner thereof;

an upper alignment plate positioned on an upper face of the printed circuit board around said fastening area;

a lower alignment plate positioned on a bottom face of the printed circuit board around said fastening area;

a first alignment member extending though all the upper plate, the printed circuit board and the lower alignment plate; and a second alignment member extending through all the housing, the printed circuit board and the lower alignment plate; wherein the housing has no direct strong retention with the upper alignment plate while having direct strong retention with the lower alignment plate via said second alignment member.

11. The electrical connector assembly as claimed in claim 10, wherein the upper plate is essentially coplanar with the housing.

* * * * *